US012385724B2

(12) United States Patent
Kwon

(10) Patent No.: US 12,385,724 B2
(45) Date of Patent: Aug. 12, 2025

(54) METHOD OF BLASTING USING JET UNITS CHARGED IN A BLAST-HOLE

(71) Applicant: Moon-Jong Kwon, Busan (KR)

(72) Inventor: Moon-Jong Kwon, Busan (KR)

( * ) Notice: Subject to any disclaimer, the term of this patent is extended or adjusted under 35 U.S.C. 154(b) by 0 days.

(21) Appl. No.: 18/209,813

(22) Filed: Jun. 14, 2023

(65) Prior Publication Data

US 2023/0324152 A1 Oct. 12, 2023

Related U.S. Application Data

(62) Division of application No. 17/287,191, filed as application No. PCT/IB2019/058930 on Oct. 20, 2019, now Pat. No. 11,719,516.

(30) Foreign Application Priority Data

Oct. 23, 2018 (KR) ..... 10-2018-0126506
Jun. 30, 2019 (KR) ..... 10-2019-0078427

(51) Int. Cl.
*F42D 1/00* (2006.01)
*F42B 1/028* (2006.01)
(Continued)

(52) U.S. Cl.
CPC ..... *F42B 1/028* (2013.01); *F42B 1/032* (2013.01); *F42D 1/08* (2013.01); *F42D 3/04* (2013.01)

(58) Field of Classification Search
CPC ..... F42D 1/00; F42D 3/00; F42D 3/04; F42D 1/04; F42D 1/08; F42D 1/10; F42B 3/08;
(Continued)

(56) References Cited

U.S. PATENT DOCUMENTS 342,423 A 5/1886 Bloem
2,662,474 A * 12/1953 Turechek ..... E21B 43/117 175/4.6
(Continued)

FOREIGN PATENT DOCUMENTS

AU 661834 8/1995
CN 1264462 8/2000
(Continued)

OTHER PUBLICATIONS

Korean Office Action issued in App. No. KR10-2019-0078427, dated Dec. 23, 2022, 5 pages.
(Continued)

*Primary Examiner* — Michael D David
(74) *Attorney, Agent, or Firm* — Gunther J. Evanina; BUTZEL LONG

(57) ABSTRACT

Liners (150), fittings (11-22), and spacers (23-25) are provided to assemble the jet (170) units, which work as explosives (110) and detonators (120) to form stand-off distance and air-deck (140) space. The liners (150) release jets (170) and the fittings (11-22) and spacers (23-25) are designed to attach the liner (150) firmly to the explosives (110), inducing the cavity effect. The objective of the present invention is to provide a blasting method using a jet (170) unit to overcome the limits of sympathetic detonation, applying a mechanism that is ideal according to the analysis of observations in blast-hole (100) blasting. The application of jet (170) units for jet (170) detonation in blast-hole (100) blasting overcomes the performance limits of explosives (110) manufacturing and the conceptual limits of detonators (120) functionalities and improves the channel effect, dead pressing, loss of power, and stopping of detonation etc. Particularly, the application of controlled blasting and air-decking can be
(Continued)

carried out without restriction while maintaining the safety of the slurry or emulsion explosives (110).

9 Claims, 9 Drawing Sheets

(51) Int. Cl.
*F42B 1/032* (2006.01)
*F42D 1/08* (2006.01)
*F42D 3/04* (2006.01)

(58) Field of Classification Search
CPC ..... F42B 3/10; F42B 3/26; F42B 1/00; F42B 1/028; F42B 1/032
USPC ..... 102/312, 275.4, 275.5, 301, 302, 331, 102/318, 333, 306, 307, 3, 10; 175/2, 24, 175/57, 4.55–4.59; 702/11; 89/1.15
See application file for complete search history.

(56) References Cited

U.S. PATENT DOCUMENTS 2,684,030 A * 7/1954 Morris ..... E21B 29/02 102/307
2,703,528 A 3/1955 Lee et al.
2,707,917 A * 5/1955 Lindsay, Jr. ..... E21B 43/117 102/310
2,775,940 A 1/1957 Klotz, Jr.
2,797,892 A * 7/1957 Ryan ..... F42D 5/055 102/307
2,837,996 A * 6/1958 Klotz ..... F42B 3/08 102/308
2,851,918 A * 9/1958 MacLeod ..... F42B 1/036 86/20.12
2,867,172 A 1/1959 Hradel
2,892,406 A 6/1959 Hradel et al.
2,897,756 A * 8/1959 Borins ..... E21B 7/007 166/299
2,936,708 A * 5/1960 Borins ..... E21B 7/007 102/307
2,984,307 A * 5/1961 Barnes ..... F42B 3/08 102/307
3,021,785 A 2/1962 Hradel et al.
3,024,727 A 3/1962 Hradel
3,077,834 A * 2/1963 Caldwell ..... F42B 1/032 102/306
3,092,025 A 6/1963 Hradel
3,282,354 A * 11/1966 Hakala ..... E21B 43/117 175/4.6
3,302,567 A * 2/1967 Venghiattis ..... E21B 43/117 102/306
3,695,715 A * 10/1972 Godfrey ..... E21C 37/00 89/1.15
3,782,283 A 1/1974 Lingens
4,122,775 A * 10/1978 Held ..... F42B 23/04 102/306
4,160,412 A 7/1979 Snyer et al.
4,282,814 A * 8/1981 Menz ..... F42C 19/0834 102/318
4,627,353 A * 12/1986 Chawla ..... F42B 1/02 102/307
4,938,143 A 7/1990 Thomas et al.
4,947,751 A 8/1990 Kennedy et al.
4,976,203 A * 12/1990 Weisshaupt ..... F42B 1/02 102/306
5,038,683 A * 8/1991 Baker ..... F42B 1/02 102/501
5,588,575 A 12/1996 Davignon
5,616,885 A * 4/1997 Walters ..... F42B 1/02 102/306
5,705,768 A 1/1998 Ey
5,780,764 A 7/1998 Welch et al.
5,798,477 A * 8/1998 Givens ..... F42B 3/26 102/302
5,859,383 A * 1/1999 Davison ..... C06B 25/34 102/307
6,213,212 B1 * 4/2001 Jenkins, Jr. ..... E21B 33/134 166/299
6,220,370 B1 * 4/2001 Wesson ..... E21B 43/119 102/323
6,324,980 B1 * 12/2001 Bianchini ..... F42D 1/18 102/333
6,330,860 B1 12/2001 Kang
6,454,359 B1 9/2002 Kang
8,272,330 B1 * 9/2012 Gold ..... F42B 1/028 102/494
8,887,609 B1 * 11/2014 Cherry ..... F42B 1/028 86/50
9,175,940 B1 * 11/2015 Collier ..... F42B 1/028
10,048,047 B2 8/2018 Van Niekerk et al.
10,227,266 B2 3/2019 Klunker et al.
10,330,445 B1 * 6/2019 Baum ..... F42B 1/032
10,450,818 B2 * 10/2019 Jenkins ..... F42D 1/18
2002/0050222 A1 5/2002 Kang
2003/0029346 A1 * 2/2003 Atkinson ..... C06B 47/00 149/46
2005/0115447 A1 * 6/2005 Zhang ..... F42D 3/00 102/475
2007/0240599 A1 * 10/2007 Pratt ..... F42D 3/04 102/307
2007/0272110 A1 * 11/2007 Brent ..... F42D 1/055 102/313
2009/0145322 A1 6/2009 Howerton
2010/0000397 A1 * 1/2010 Pratt ..... E21B 43/117 89/1.15
2012/0024528 A1 * 2/2012 Mytopher ..... E21B 43/11852 166/298
2013/0152812 A1 * 6/2013 Brent ..... F42D 1/055 102/312
2014/0116775 A1 * 5/2014 Coffey ..... E21B 43/11852 175/2
2015/0041135 A1 * 2/2015 Coffey ..... E21B 43/11852 166/297
2016/0069655 A1 * 3/2016 Brent ..... F42D 3/04 102/312
2016/0130902 A1 * 5/2016 Wright ..... F42C 19/02 89/1.15
2016/0377392 A1 * 12/2016 Lee ..... F42D 1/20 102/312
2017/0038188 A1 * 2/2017 Handel ..... F42D 1/20
2018/0299234 A1 * 10/2018 Baum ..... F42B 1/036
2019/0331471 A1 * 10/2019 Un ..... F42D 1/22
2020/0158479 A1 * 5/2020 Boulanger ..... F42B 1/028
2021/0302134 A1 * 9/2021 Galloway ..... F42B 1/028
2022/0154559 A1 * 5/2022 Sadler ..... E21B 43/117

FOREIGN PATENT DOCUMENTS

CN 203837604 9/2014
CN 108613603 10/2018
CN 108662956 10/2018
DE 3610149 10/1987
DE 3610149 A 10/1987
JP 2003240498 1/2007
KR 100316161 B1 4/2001
KR 20010027924 4/2001
KR 1020040001724 1/2004
KR 20040075612 8/2004
KR 101656200 B1 9/2016
KR 101972124 B1 4/2019
KR 101979251 B1 5/2019
KR 102037939 B1 10/2019
KR 102162731 B1 9/2020

OTHER PUBLICATIONS

Chinese Office Action issued in App. No. CN201980085507.2, dated May 12, 2023, 7 pages.

(56) References Cited

OTHER PUBLICATIONS

Liu L. Katsabanis P.D. Rock Fragmentation by Blasting, Monhanty (ed.) Balkema, Rotterdam. (1966), pp. 319-330 Numerical Modeling of the effects of air decking/decoupling in production and controlled blasting. In *Proceedings of the Fifth International Symposium on Rock Fragmentation by Blasting*, Montreal, Canada, dated Dec. 2020, 7 pages.

Donald R. Kennedy, "History of the Shaped Charge Effect: The First 100 Years," Paper/Symposium, (1990), pp. 3-14 pp. 65-70, Los Alamos National Laboratory, Los Alamos, New Mexico, dated Apr. 30, 1990, 140 pages.

Charles E. Munroe "On certain phenomena produced by the detonation of gun cotton," Report No. 6. (1888) *Proceedings of the Newport Natural Historical Society* 1883-1886, [Rhode Island], 8 pages.

Charles E. Munroe "The applications of explosives" (1900) pp. 300-312, 444-455. Appleton's *Popular Science Monthly*, vol. 56, A description of Munroe's first shaped-charge experiment appears on p. 453, 12 pages.

Charles E. Munroe "Modern Explosives," (1888) Scribner's Magazine, vol. 3, pp. 563-576, 14 pages.

A Non-Ideal Detonation Model for Evaluating the Performance of Explosives in Rock Blasting—final, dated Sep. 21, 2006, 32 pages.

Eugie Kabwe "Velocity of detonation measurement and fragmentation analysis to evaluate blasting efficacy" Journal of Rock Mechanics and Geotechnical Engineering 10 (2018) 523e533, dated Dec. 21, 2017, 11 pages.

S.K. Roy, R.R. Singh, R. Kumar, and U.K. Dey "effect of using plastic spacers on toxic fume generation by permitted explosives," The Journal of The Southern African Institute of Mining and Metallurgy vol. 108 Refereed Paper Nov. 2008 pp. 691-699, 9 pages.

S. Rommayawes, C. Leelasukseree, P. Jaroonpattanapong, "Influence of Air-Deck Length On Fragmentation in Quarry Blasting," European scientific Journal Dec. 2013/Special/edition vol. 3 ISSN 1857-7881 (Print) e-ISSN 1857-7431, 8 pages.

R.Q. Eades and K.A. Perry, "Understanding the Connection between Blasting and Highwall Stability," International Journal of Mining Science and Technology, vol. 29, No. 1, pp. 99-103, China University of Mining and Technology, Jan. 1, 2019, 6 pages.

International Search Report and Written Opinion, Nov. 13, 2019, 8 pages.

* cited by examiner

METHOD OF BLASTING USING JET UNITS CHARGED IN A BLAST-HOLE

CROSS-REFERENCE TO RELATED APPLICATIONS

This application is a division of U.S. application Ser. No. 17/287,191, filed on Apr. 21, 2021, and claims priority to a U.S. national stage application which claims priority to PCT Application No. PCT/IB2019/058930, filed on Oct. 20, 2019 and which claims priority to Korean Application Nos. 10-2019-0078427, filed on Jun. 30, 2019 and 10-2018-0126506, filed on Oct. 23, 2018, respectively, all of which are incorporated herein by reference in their entireties.

FIELD OF THE DISCLOSURE

This invention relates to blasting with explosives and more particularly to a blast-hole blasting method, employing a jet unit applying the shaped charge effect, to realize the ideal mechanism of the explosion and breakage analysis.

BACKGROUND OF THE DISCLOSURE

The history of blasting can be divided into the development of explosives and detonators, and the changes in their use. And so far, better blasting methods have been pursued with imagination based on observation of various phenomena.

Explosives have developed from black powder to dynamite, ANFO, slurry, emulsion, and so forth while similarly, the evolution of the electric detonator, non-electric detonator, and electronic detonator have continued since the invention of the blasting cap and detonator. Thus, the safety of explosives and the precision of the detonator have improved greatly. As for the technological progress of blasting, the blasting of the explosives charged in a blast-hole was established in the 17th century. Ensuing the observation of various phenomena, an air-deck method utilizing analytical detonation reactions was implemented, and research on a jet-powered shaped charge continued.

Of particular note, in 1893, when Knox discovered and patented that void space (air-deck) inside the blast-hole increased the efficiency of blasting charged with gunpowder. Regarding the detonator, in 1886, G. Bloem patented the formation of a hemispherical base of the detonator to increase the force of detonation.

According to the analysis of macroscopic mechanisms known to date, rocks are cracked up to 9 ms due to the dynamic and static effects of the explosion reaction. Movement of the crushed rock begins after 9 ms, and the crater production is completed in 15~30 ms.

In addition, observation of the air-deck's microscopic mechanisms has been reported to show that shock waves within 4~8 ms have a decisive effect on the fracturing of the rock. [Liu, L., Katsabanis P. D. (1996), Numerical modeling of the effects of air-decking/decoupling in production and controlled blasting. *Rock Fragmentation by Blasting*, Monhanty (ed.), Balkema, Rotterdam, pp. 319-330].

The development of the basic principle of the shaped charge began much earlier and took longer than that of the air-deck. The fundamental structure of the modern-day shaped charge (incorporating the stand-off distance starting with the observation of the cavity effect) took roughly 150 years to establish. [Kennedy, D. R. (1990), *History of The Shaped Charge Effect: The First* 100 *Years*, Defense Technical Information Center, pp. 3-14]. In the process, a number of invention patents have been proposed.

On the other hand, the detonating action of the detonator can be divided into fragments, heat, and shock waves. Regarding the detonation of cap sensitive explosives, fragments play the most important role in detonating explosives. It is reported that ammonium nitrate detonates at a distance of 1 m by the fragments in experiment.

In the jet of the shaped charge effect, a shock wave generated when the explosive is detonated and transmitted to the liner, and the collapsed liner forms the jet of high temperature and high pressure in the axial direction. The stand-off distance between the liner and the target further enhances the effect. For metal liners, the jet temperature is above 500 degrees and the speed reaches 12.5 km/s, more than twice the fragments velocity of the detonator.

SUMMARY OF THE DISCLOSURE

In accordance with the analytical observation and practical application of drilling blasting to date, the most ideal mechanism is to complete at once, on a molecular basis, the detonation reaction of a charged explosive before the destruction of the blast-hole wall proceeds. Consequently, it is possible to complete the cracking and crushing of the blasting object by converting both the shock wave energy of the primary detonation reaction and the chemical energy of the secondary reaction product into kinetic energy. In other words, to reduce the completion time of the detonation reaction of the charged explosives, increase the degree of completeness, and induction of the shock wave emission of chemical products in accordance with the detonation reaction will lengthen the duration of the reverberation significantly.

However, concerning the current blast-hole blasting method, two factors hinder the progress of the ideal mechanism. These can be divided into the manufacturing and practical limitations of the explosives and detonators.

Regarding explosives, the explosion of slurry and emulsion explosives (which currently occupies most of the industrial explosives with superior stability compared to dynamite) have a manufacturing limitation based on the hot spot theory by adiabatic compression of bubbles. In terms of detonation, the precision and accuracy of the detonator have reached 1 ms, but its role is only fulfilled at the moment of detonation and propagation is conceptualized as being dependent on the sympathetic detonation of the loading charge.

For this reason, the explosive energy cannot be efficiently used in blast-hole blasting. There have been disadvantage phenomena such as the channel effect and dead-pressing phenomenon or deceleration and detonation failure in the case of narrow drilling pattern or deep holes, in the use of various sites such as bench blasting, tunnel blasting, and underwater blasting. In particular, the air-deck charging method is more efficient at using 10-30% of the charged explosives in theory, however, in practice, the smaller the diameter and deeper the depth of the blast-holes, the more frequently the problems occur, thus making the result less efficient than the conventional method.

Concerning this circumstance, U.S. Pat. No. 6,330,860 still does not compromise the borrowed use of the early air-deck discovery and fails to account for the loss of detonation velocity and power in sympathetic detonation. Thus, it does not necessarily provide a practical alternative, which this invention addresses. U.S. Pat. No. 5,705,768 is borrowed without developing upon the basic form of the shaped charge consisting of the existing housing, explosives, detonator, and liner. There is no use of the stand-off distance; accounting for only the concept of direction and no concept of speed. The role of the liner is also limited to only the cavity effect and not the jet effect. The use of the hemispherical liner with half the speed of the jet compared to the cone, and the jet effect using a high speed of the conical liner is also negatively taught so that it is difficult to achieve the effect of sufficient jet detonation. Kennedy's report above is reminiscent of the WASAG (1910) patent, which applied the cavity effect only to direct fracturing, as it has been continuously used ineffectively so far in blast-hole blasting. In other words, it is not the principle of the shaped charge but only part of the shape from the shaped charge.

In this method, both patents apply special phenomena from the history of blasting, each with its own limitations, suggesting opposite directions for the application and implementation of the ideal concept of blast-hole blasting. Such methods are conditioned on the limitations of explosives manufacturing according to the hot spot theory and the conceptual limits of the detonator's function, which rely on the sympathetic detonation of blast-hole blasting. In addition, the explosive energy cannot be efficiently used and the application to various blasting environments or to other charging methods such as air-decks exposes many problems.

The present invention is to provide a blasting method using a jet unit in which the shaped charge effect is applied as a method of practicing the ideal mechanism of blast-hole blasting based on the analysis of the observations described above.

In the history of blast-hole blasting, many better methods have been proposed so far, but no technical solution has been provided for the concept of ideal blasting by analysis of observations. The reason for this is that the analysis was difficult at the time of discovery of both the two phenomena mentioned above. The use of black powder and dynamite may have been the reason for no apparent need for consideration of the dead-pressure phenomena of explosives produced on the basis of the hot-spot theory or for the widespread application of the air-deck phenomenon.

Liners, spacers, and fittings are provided to make a jet unit that acts as explosives and a detonator in blast-hole blasting. The liner can be made of materials such as metal, plastic, ceramic, or glass, etc., which are capable of emitting a jet during the detonation reaction. The shape of the liner is planar, spherical, conical, etc. which can vary the speed, length and width of the cross-section of the emitted jets, depending on the intended application. Primarily, cones with a vertex angle of 40 to 90 degrees which the generatrix is straight or curved, are sufficient to induce jet emission. The spacers and fittings can be made of plastic and materials similar to plastic or environmentally friendly materials. The spacers' end portion can be shaped like the liner to support the liner or other spacers and to induce the cavity effect in the charged explosives. One side of the fittings are designed to accommodate primers, boosters, or charged explosives, while also attaching the liner in close contact, while the other side can be further extended to form a stand-off distance, and/or to accommodate explosives or spacers.

According to the predetermined plan, drill the blast-hole (s) on the object of fracture such as rock or concrete. Regarding the methods of charging the jet unit for jet detonation, one or more primers, boosters, or column charges are loaded in the blast holes; mount at least one liner to the loaded explosives for jet ignition; form empty spaces between the explosives to be used as a stand-off distance and an air-deck. The length is adjusted with respect to the strength of the rock, drilling patterns, and types of explosives. In this case, attach or mount liners using a spacer or fitting to increase workability. Double check the charge, detonate the primer, and complete propagation as the jet is released by the liner for detonation.

The jet detonation proceeds faster than the detonation of the charged explosive, and exceeds the propagation speed of the shock wave (through the air gap) between the charge and blast-hole, and the released jet fragments and its energy detonate the charges in the blast-hole rapidly. In addition, the detonation reaction of the charged explosives propagates in all directions along the axis to maximize efficiency.

As such, the jet unit overcomes the performance limits of explosives manufacturing, and the conceptual limits of detonators' functionalities, and also improves the channel effect, and dead pressing, and prevents loss of power and halt of detonation, etc. The application of controlled blasting and air-decking can be carried out without restriction while maintaining the safety of slurry or emulsion explosives.

In particular, microscopic observation of rock breakage by the air-deck charging method has proven to have a decisive impact on shock waves within 4-8 ms. Prerequisites for this are to reduce the completion time of the detonation reaction of the explosives, increase their maturity, and induce and sustain the shock waves release of chemical products following the detonation reaction. The jet unit reduces the completion time of the detonation reaction and increases the degree of completion. The stand-off distance further accelerates the speed of the jet, and combined with the proper arrangement of the air-deck, also ensures that the chemical product of the detonation reaction releases its energy as a shock wave greatly improving its reverberation.

The jet unit improves the efficiency of explosives in blast-hole blasting, thereby reducing the influence on adjacent holes during tunnel blasting and increasing the rate of excavation and being advantageous for over-break management. It also increases the productivity and workability by overcoming the effects of the detonation due to water pressure in underwater blasting and can be an essential application during controlled blasting. When applied to all blast-hole blasting, explosive efficiency can be increased to improve productivity and prevent pollution and environmental issues such as vibration and noise.

In blast-hole blasting, the explosion using the jet unit could lead to the reconsideration and change of basic design elements such as sensitivity, pressure resistance, and detonation velocity, etc., in the manufacturing method of industrial explosives. In addition to the classification of industrial explosives (which are classified currently cap sensitive and booster sensitive), it will be possible to manufacture safer jet sensitive explosives by adapting the activation energy to the jet detonation. Furthermore, it will accelerate the methods of achieving said efficiency by detonating the loading explosive at once on the molecular basis.

The configuration, operation, and applications of the present invention will be described with reference to the accompanying Figures.

DETAILED DESCRIPTION

FIGS. 1A to 1D illustrate the problems of the prior art and their solutions provided by a detonating jet.

Figure 1A:
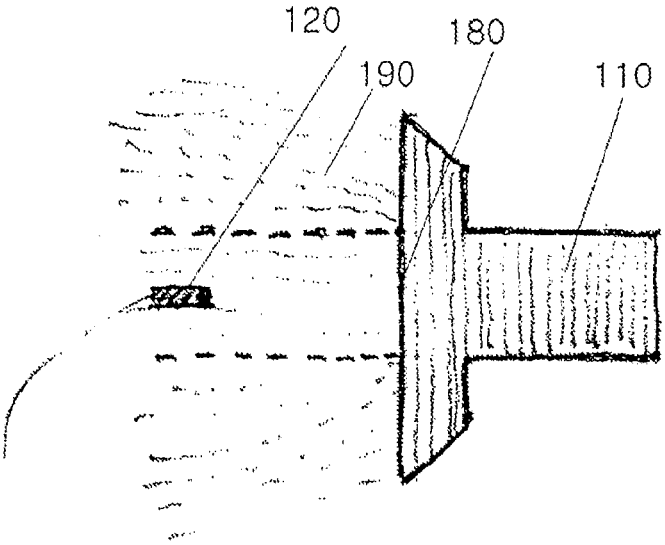
FIG. 1A is a sectional side view illustrating the detonation reaction zone by the detonator.

FIG. 1A shows the detonation reaction caused by the propagation of the explosives 110 of the detonator 120. Shock wave and explosion product 190 are generated in the detonation reaction zone 180.

Figure 1B:
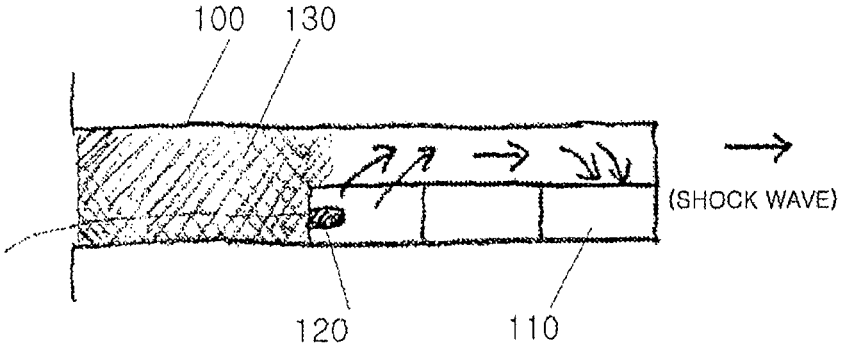
FIG. 1B is a sectional side view illustrating the dead-pressing phenomenon by the channel effect.

FIG. 1B is a diagram showing the cause of the channel effect. The shock wave originating from the detonation of the detonator 120 passes between the blast-hole 100 and the explosive 110 to reach the explosive 110 which has not yet been detonated, thereby reducing the sensitivity. This reduces the efficiency of explosives 110 and results in misfired charges. This phenomenon becomes evident when using slurry or emulsion explosives manufactured on the basis of hot spot theory in small tunnels. This reduces efficiency in controlled blasting and bench blasting in construction and mining and limits the potential for wider implementation of air-decking.

Figure 1C:
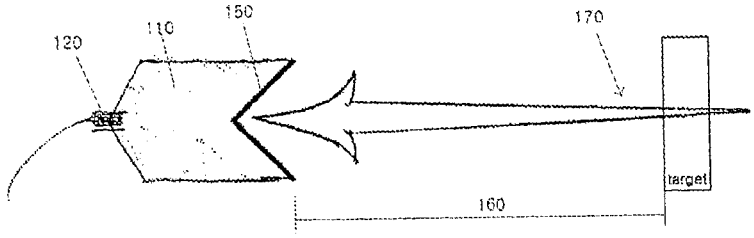
FIG. 1C is a sectional side view illustrating the jet generated by the shaped charge.

FIG. 1C shows the jet 170 produced when the shaped charge is detonated by the detonator 120. The shock wave generated by the explosive 110 transmits to and collapses the liner 150. The collapsed liner 150 forms a jet 170 of high temperature and pressure in the axial direction. The temperature of the jet 170 is above 500 degrees and the speed reaches 12.5 km/s, more than twice the speed of the fragments of the detonator 120. At this time, the stand-off distance 160, which is the distance from the liner 150 to the target, further accelerates the jet 170 emitted by the liner 150.

Figure 1D:
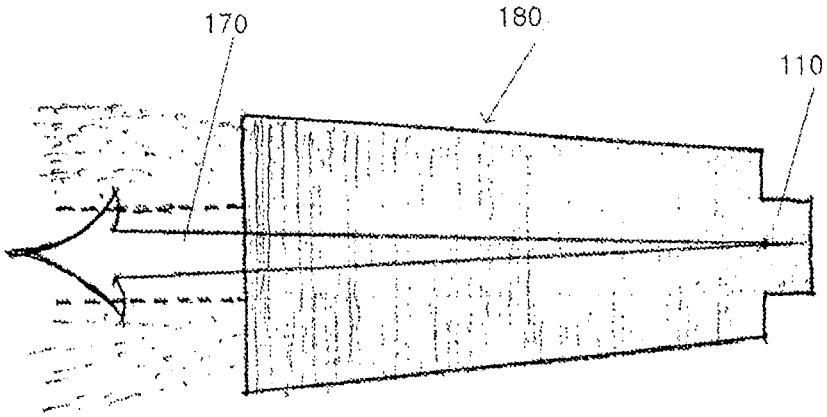
FIG. 1D is a sectional side view illustrating the detonation reaction zone by the jet.

FIG. 1D shows the detonation reaction zone 180 of cartridge explosives 110 which are detonated by the jet 170 emitted by the shaped charge. As such, it can be seen that the detonation reaction zone 180 by the jet 170 is greatly different from that by the detonator 120 in FIG. 1A. The detonation by the jet 170 of the liner 150 proceeds faster than the propagation of the explosion by the conventional sympathetic detonation in the blast-hole 100 blasting, and exceeds the propagation speed of the pressure by the shock wave through the air gap of the blast-hole 100.

As described above, detonation by the jet unit of FIGS. 3A to 3C is to reduce the completion time of the detonation reaction and to increase the degree of completion, to effectively use the explosive 110, and to improve the channel effect, dead pressure phenomenon, and prevent the loss of power and halt of detonation. This is because the emitted jet 170 fragments and their energy not only detonate explosives 110 in the blast-hole 100 in a short time, but the detonation reaction of the charged explosives 110 occurs all along the axis, maximizing its efficiency.

Figure 2A:
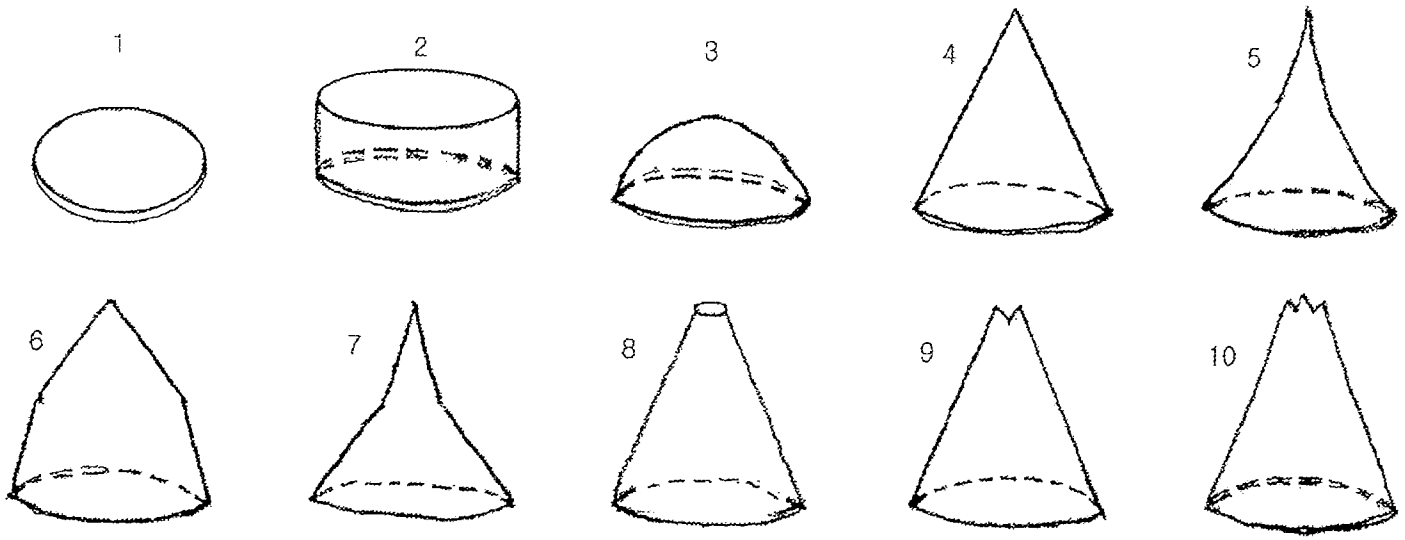
FIG. 2A is a diagram showing the shapes of detonation liners.
Figure 2B:
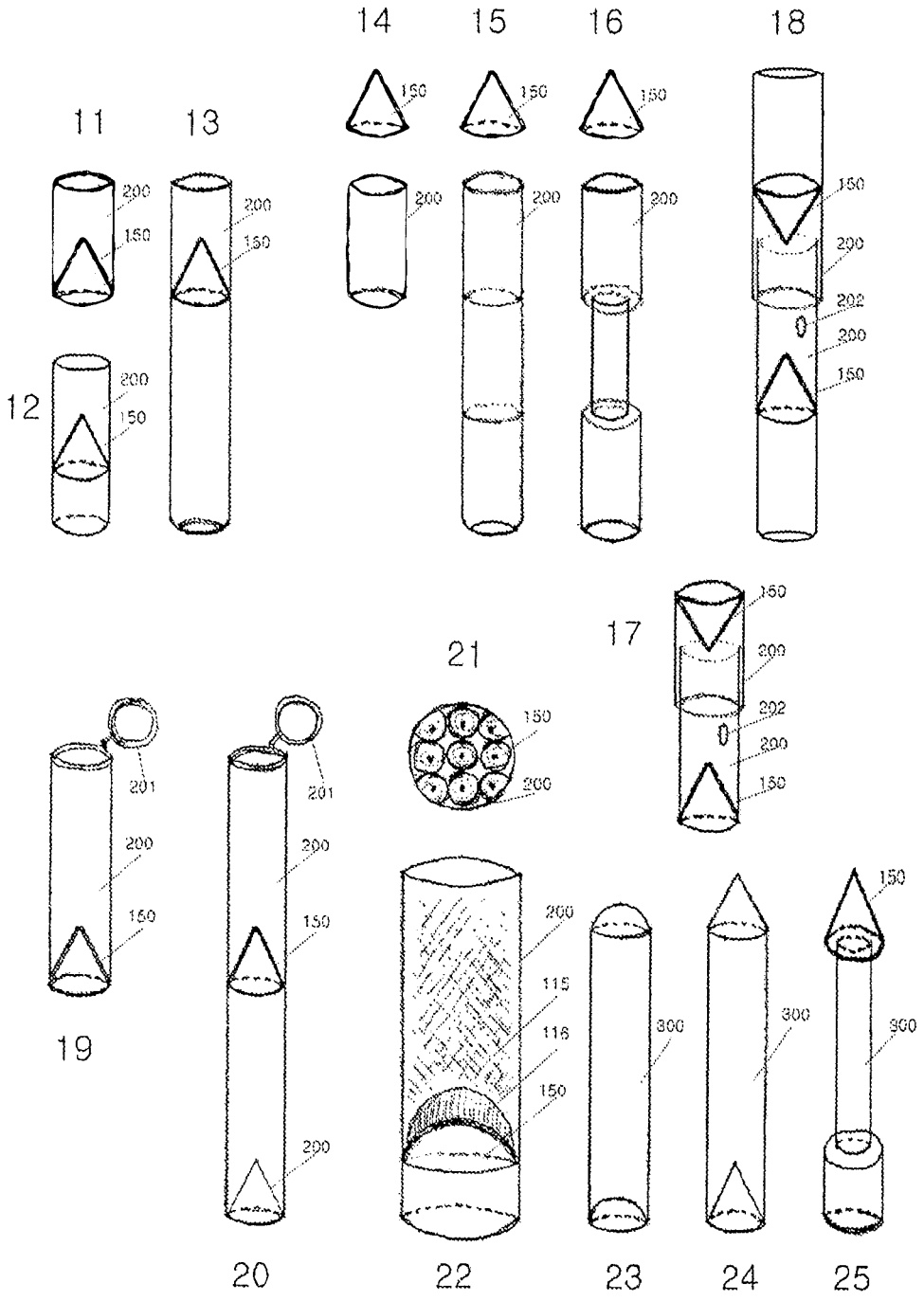
FIG. 2B is a diagram showing the shapes of fittings and spacers.

FIGS. 2A and 2B are described with reference to the diagrams for the production of liners (1~10), fittings (11~22), and spacers (23~25). In the practice of the present invention, it can be loaded by simply attaching the liner (1~10) to the explosives 110, but also as shown in FIG. 2B for convenience and workability of mounting the liner (1~10), as well as forming the stand-off distance 160. Fittings (11~22), such as the integral type (11~13), detachable type (14~16), bidirectional types (17, 18), waterproof type (19, 20), application type (21, 22), and spacers (23~25) may be selected and applied according to the characteristics of each task. Particularly, when both ends of the spacers (23~25) are formed in the shape of a liner, such as a curved surface 23 or a conical shape 24, they are suitable for supporting the liner 150 and inducing the cavity effect to the charged explosives 110, consistent with the implication of the present method. If the diameter of the blast-hole is larger than the diameter of the fittings or the spacers in FIG. 2B, the jet units shown in FIGS. 3A, 3B, and 3C are to be installed parallel to the blast-hole by making it possible to attach a straight or circular wing to the spacer or the fitting.

FIG. 2A shows the various shapes available for the manufacturing of the detonation liners 1 to 10. Flat type (1, 2), Curved type (3), Conical type (4), Trumpet type (5), Double Cone type (6, 7), Flat Top type (8), Recessed type (9), Double Nipple type (10). The liners (1~10) can vary in speed, length and width of the cross-section of the jet 170, depending on its shape. The material may be metal, plastic, ceramic or glass etc.; it emits the jet(s) 170 following detonation of the explosives 110, depending on the characteristics such as friction or impact for work safety, and the temperature of the jet(s) 170.

FIG. 2B shows the various shapes available for the manufacturing of the fittings (11~22) and spacers (23~25): Integral type of fitting and liner (11), Integral type of fitting and liner with an extension (12), Integral type of fitting and liner with stand-off distance (13), Detachable type of fitting and liner (14), Detachable type of fitting and liner with stand-off distance (15, 16), Bidirectional fitting and liner (17), Bidirectional fitting and liner with stand-off distance (18), Waterproof fitting and liner (19), Waterproof fitting and liner with stand-off distance (20), Spherical shaped fitting and liner (21), Application type for centralized jet (22), Hemispherical shaped spacer (23), Conical shaped spacer (24), Spacer for supporting liner and with cartridge receiver (25). The bidirectional fittings (17, 18) may mount the detonator 120 through the detonator insert 202. Waterproof fittings (19, 20) can be used by inserting or filling explosives 110 and closing the lid 203 for waterproofing. The spherical 21 can be used for large diameters, while the application type 22 can be used for high-explosives 115 and lowexplosives 116, where the jet must be concentrated in one place. The fittings (11~22) and spacers (23~25) may be made of plastic materials similar to plastic or eco-friendly materials.

Figure 3A:
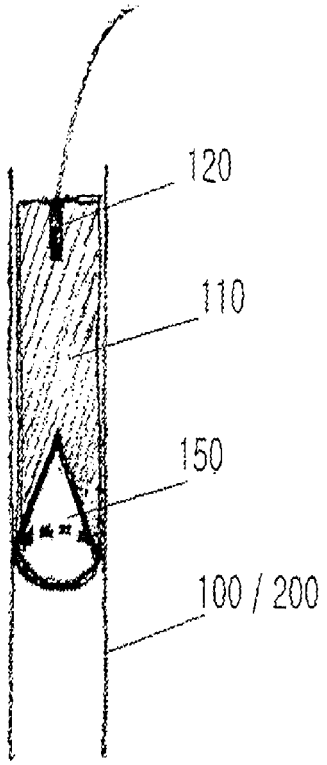
FIG. 3A is a diagram showing a detonator on the jet unit.
Figure 3B:
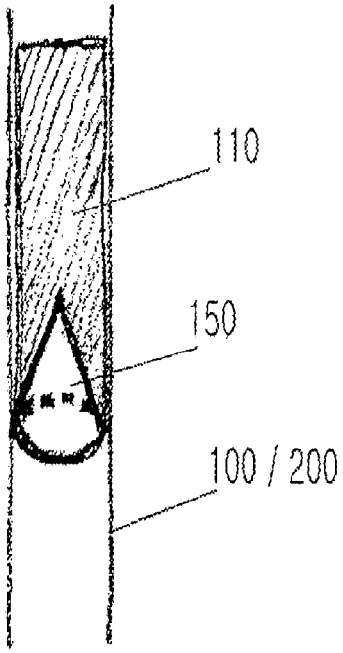
FIG. 3B is a diagram showing the basic shape of the jet unit.
Figure 3C:
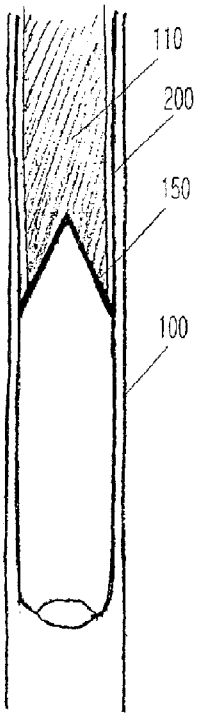
FIG. 3C is a diagram showing the basic shape of the jet unit with the stand-off distance.

FIGS. 3A, 3B, and 3C are jet units for jet detonation in blast-hole blasting. They act as explosives 110 and detonators 120, enabling the ideal blast-hole blasting following observation and analysis from the constraint of the implicit concept that "all propagation of detonation depends on the sympathetic detonation between charged explosives" since the invention of detonators 120. As shown in FIG. 3C, the fittings with (13, 15, 16, 18, 20), and without (11, 12, 14, 17, 19, 22) the stand-off distance 160 may be more effective and convenient. The stand-off distance 160 accelerates the jet 170 and serves as the space for the air-deck 140, making it possible to use the explosives 110 more efficiently than the conventional air-deck 140 method.

For jet detonation in blast-hole blasting: Firstly, the liner 150 is attached to the explosives 110, primer 111, booster 112, or column charge 113, mainly by using a straight or curved line of the generatrix of the cone to sufficiently induce the emission of the jet 170. The method of attaching the liner 150 is as shown in FIG. 3A. In the case of a cone shape, the rotation axis of the cone 150 coincides with the supposed long axis of the blast-hole 100, the cartridge explosives 110, the detonator 120, and the underside of the explosives to be attached. It should be made sure that the explosives 110 are in close contact with the outer surface of the liner 150.

Secondly, after attaching the liner 150, it is possible to induce acceleration on the jet 170 released by the liner 150 by setting the stand-off distance 160. This amplifies the detonation force of the jet 170. In the case of long-hole blasting, this has the advantage of further accelerating the detonation. In the case of the conical liner 4, the stand-off distance 160 may be applied at 2 to 8 times the diameter depending on the material to be manufactured for the penetration or cutting of the steel. Shorter or longer alterations of the stand-off distance do not interfere with the detonation of the explosives. As a simple test blasting according to the situation of the site, it can account for various variables such as the material and shape of the liner 150.

Thirdly, in the above-mentioned bench blasting, tunnel blasting, controlled blasting, underwater blasting, etc., determines the loading amount according to the working situation, attach the liner 150, set the stand-off distance 160, and then use spacer (23~25) between the charges. By doing this, the efficiency of various blasting methods can be improved, and in particular, the air-deck method can be widely applied. Various types of liners (1~10), fittings (11~22), and spacers (23~25) shown in FIGS. 2A and 2B may be selected according to the types and characteristics of the above operations.

FIGS. 4A to 4D are conventional methods, all of which only rely on sympathetic detonation for the charged explosives (111~114). With regard to an issue in blast-hole blasting, the shock wave energy following the crushing of the blast-hole wall is expended in pollution.

Figure 4A:
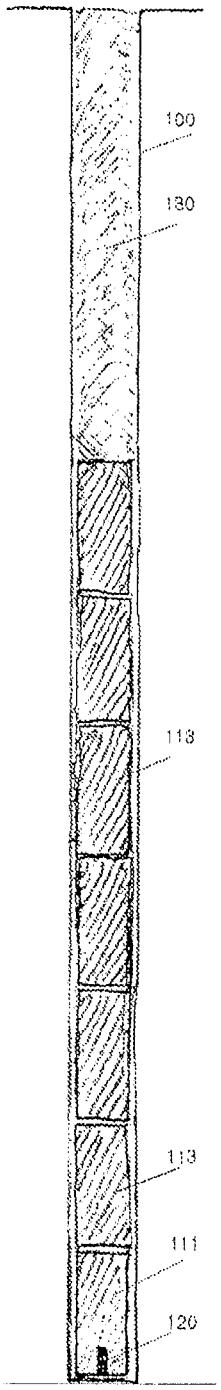
FIG. 4A is a sectional side view of a charging method of cartridge explosives according to the prior art.

FIG. 4A is a representative method of the prior art; after placing the primer 111 with a detonator 120 at the bottom of a blast-hole 100, the column charge 113 located on the top, and stemming 130. In some cases, the primer 111 may be placed in the middle of a charge or just before the stemming 130.

Figure 4B:
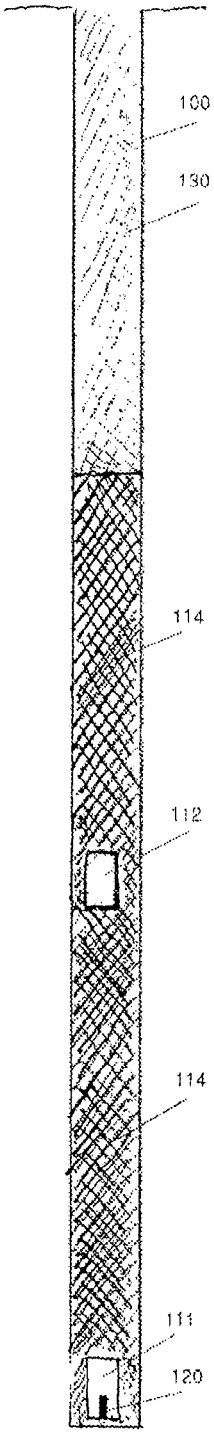
FIG. 4B is a sectional side view of a charging method of bulk explosives according to the prior art.

FIG. 4B is a conventional technique in which a primer 111 is placed with a detonator 120 at the bottom of the blast-hole with loaded bulk explosives 114. In most cases, to increase the power of detonation, a booster 112 is placed in the middle of the charge. Even if the booster 112 is placed in the middle of the charge, the efficiency of the blasting is limited as a method of sympathetic detonation, and the potential wide implementation of the air-deck is restricted. When applied to large-scale bench blasting, the loss of power and halt of detonation are not distinctly recognizable, but there is much room for improvement from the perspective of the ideal method of a detonation reaction.

Figure 4C:
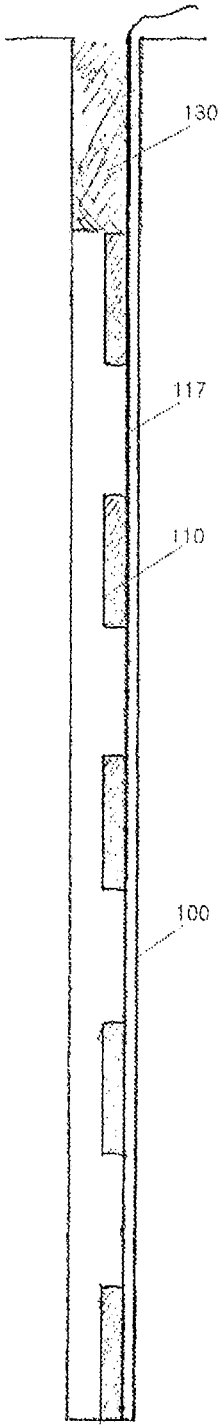
FIG. 4C is a sectional side view of a charging method of pre-splitting according to the prior art.

FIG. 4C is a method of pre-splitting, which is a kind of controlled blasting of the prior art. The explosives 110 (with diameters smaller than the blast-holes diameters) attach to the detonating cord 117 at regular intervals to detonate them. Controlled blasting is carried out by decoupling charges in order to soften the shockwave during the detonation. When the air-deck method is applied to avoid noise generated by the detonating cord 117, the workability is inferior due to the channel effect.

Figure 4D:
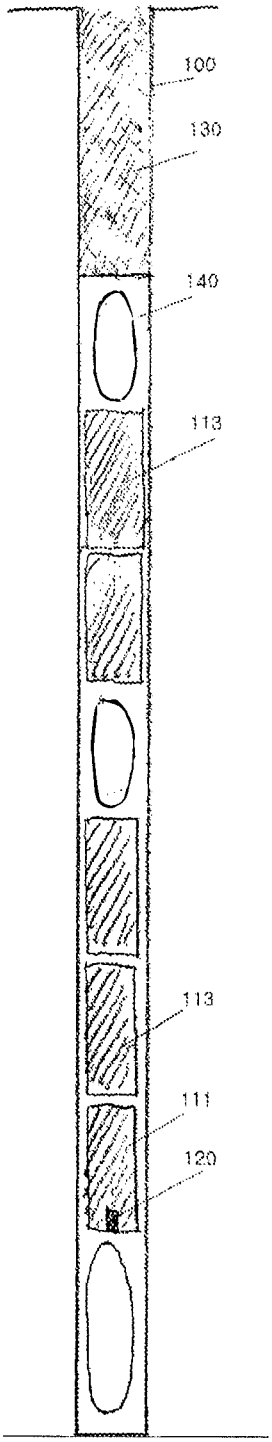
FIG. 4D is a sectional side view of a charging method of air-decking according to the prior art.

FIG. 4D is the air-deck 140 charging method of the prior art to charge the primer 111 and column charge 113. It is mainly arranged with the empty space at the bottom, center, and top of the charge. Thus, the column charge 113 depends on the sympathetic detonation, reducing the detonation velocity; thereby restricting the use of the air-deck. Regarding the ideal use of the detonation reaction, there is much room for improvement as shown in FIG. 4B.

FIGS. 5A to 5D are charging methods for jet detonation in the present invention, loading a jet unit acting as explosives 110 and a detonator 120 in a blast-hole 100. The jet unit concentrates and amplifies the detonation force of the detonator 120; it reduces the completion time of the detonation reaction and enhances its degree of completion. In particular, spacers 300, such as curved 23 or conical 24 ends; the same as the liner's shape, are used to support the liner 150 and form a stand-off distance 160 and air-deck 140. With the utilization of the jet 170 detonation and the cavity effect of the charged explosive 110, the ideal mechanism is further enhanced.

Figure 5A:
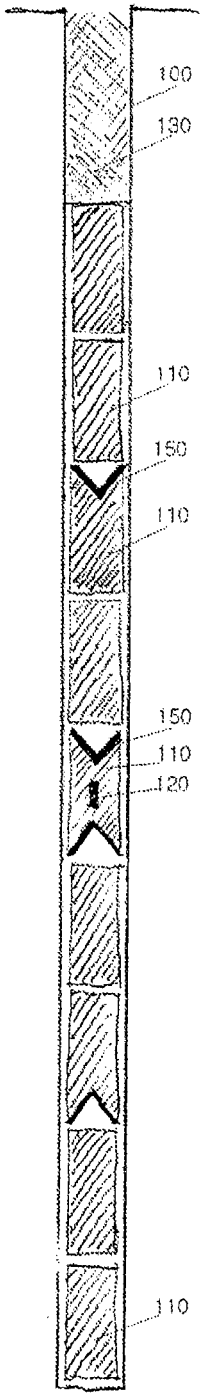
FIG. 5A is a sectional side view of a charging method of cartridge explosives in accordance with an embodiment of the present invention.

FIG. 5A is a method of applying the jet detonation to the simplest charging method of the prior art. The explosive 110 and detonator 120 are placed in the blast-hole 100, and the primer 111 is placed in the middle of the charge. By deploying a jet unit that acts as an explosive 110 and a detonator 120 using the detonating liner 150, the propagation of detonation can be further accelerated and completion time of the explosion reaction reduced. The lack of stand-off distance 160 and air-deck 140 reduce the efficiency of the explosive, but the faster detonation further enhances the explosive's power, making it more effective than conventional methods in cast blasting that require throwing.

Figure 5B:
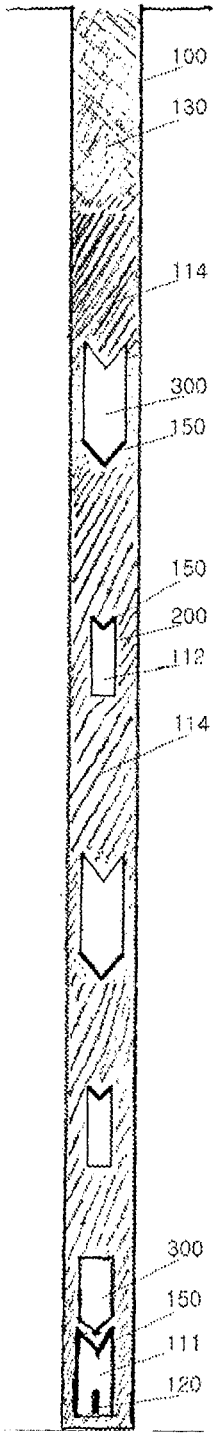
FIG. 5B is a sectional side view of a charging method of bulk explosives in accordance with an embodiment of the present invention.

FIG. 5B shows a bulk explosive 114 loaded in a blast-hole 100. A liner 150 is attached to the primer 111 and has a spacer 300 installed to induce acceleration of the jet 170. In addition, by attaching the liner 150 to the booster 112 and spacer 300, the propagation of the detonation can be accelerated further than the conventional method, as well as having reduced the completion time and increasing the degree of completion of the detonation, in order to enable the air-deck to be carried out without restriction.

Figure 5C:
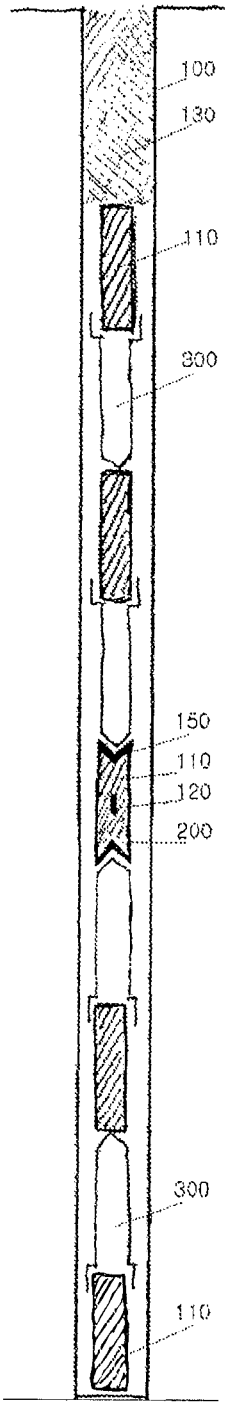
FIG. 5C is a sectional side view of a charging method of pre-splitting in accordance with an embodiment of the present invention.

FIG. 5C is an example of the decoupling charge, in which the blast-hole 100 is alternately loaded with the explosives 110 and spacer 300. The positioning of the primer 111 in the middle can reduce the completion time of detonation. In controlled blasting such as pre-splitting, cushion blasting, and smooth blasting, decoupling charges are performed. The decoupling charge is a blasting method that controls the shock wave acting on the wall of the blast-hole 100, by using explosives 110 about 2~3 times smaller than the blast-hole diameter. The conventional method using the detonating cord 117 causes noise, and the air tube method has the problem of a sympathetic detonation. Using the liner 150 and spacer 300 according to the method of the present invention can solve the two problems mentioned above and can also be applied to quarrying by extending the stand-off distance 160 and the air-deck 140.

Figure 5D:
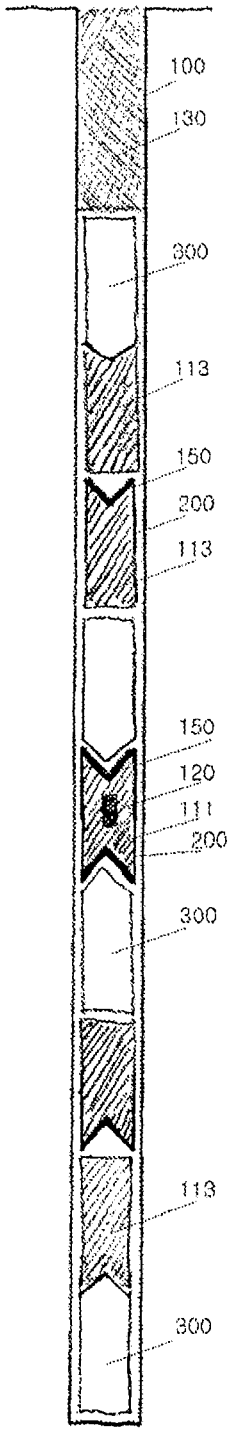
FIG. 5D is a sectional side view of a charging method of air-decking in accordance with an embodiment of the present invention.

FIG. 5D illustrates an air-deck 140 charging method of the present invention, in which two-way jet units are deployed in the center of the charge. The air-deck may be placed where the degree of breakage is to be increased and selecting the position of the detonation in the middle may reduce the time for the completion of detonation. Fittings 200 and spacers 300 will allow for various modifications to the jet unit's location and air-deck charge methods. Air-decks 140 are formed by using spacers on the lower and upper part of the blast-hole 100, and a primer 111 having the detonator 120 fixed thereto is placed in the center, and a stand-off distance 160 of the liner 150 is formed. The microscopic observation of the breakage effect by the air-deck 140 charging method has been reported to have a decisive effect on the shock wave within 4-8 ms, while jet units with the jet liner 150 reduce the completion time of the detonation reaction of the charged explosive and increase its maturity. The spacing by the stand-off distance 160 and spacer 300 is sufficient to allow the chemical product 190 of the detonation reaction to release its energy as a shock wave, and the duration of the reverberation is greatly improved. Thus, the jet detonation by the jet unit enables the ideal implementation in the practical application according to the experimental theory of blasting by analysis of the mechanism of the detonation reaction.

The above description is intended to be illustrative, not restrictive. The scope of the invention should be determined with reference to the appended claims along with the full scope of equivalents. It is anticipated and intended that future developments will occur in the art, and that the disclosed devices, kits and methods will be incorporated into such future embodiments. Thus, the invention is capable of modification and variation and is limited only by the following claims.

What is claimed is:

1. A fitting assembly comprising a cylindrical fitting and one or more liners for detonation, wherein the liner(s) for detonation is integrally or detachably attached to the cylindrical fitting, and the liner(s) for detonation is oriented along the longitudinal axis of the cylindrical fitting.

2. The fitting assembly according to claim 1, wherein the bottom surface of the liner(s) for detonation is aligned with one of both ends of the cylindrical fitting, or the bottom surface of the liner(s) for detonation is located between both ends of the cylindrical fitting.

3. The fitting assembly according to claim 2, wherein the fitting assembly has two liners for detonation and the bottom surface of one of the liners faces to one end of the cylindrical fitting and the bottom surface of the other liners faces to the opposite end of the cylindrical fitting.

4. The fitting assembly according to any one of claims 1 to 3, wherein the cylindrical fitting has an insert hole through which a detonator is inserted.

5. The fitting assembly according to any one of claims 1 to 3, wherein at least one of both ends of the cylindrical fitting has a lid.

6. The fitting assembly according to any one of claims 1 to 3, wherein the liner(s) for detonation is made of at least one of materials selected from the group consisting of metal, plastic, ceramic and glass.

7. The fitting assembly according to claim 6, wherein the shape of the liner(s) for detonation is selected from the group consisting of flat type, curved type, conical type, trumpet type, double cone type, flat top type, recessed type, double nipple type.

8. A jet unit for detonation comprising a fitting assembly according to any one of claims 1 to 3 and a cylindrical spacer attached to the fitting assembly.

9. The jet unit for detonation according to claim 8, wherein at least one of both ends of the spacer is formed in a curved shape or in a conical shape.

* * * * *